US005326143A

United States Patent [19]

Babler

[11] Patent Number: 5,326,143

[45] Date of Patent: Jul. 5, 1994

[54] REFUSE COLLECTING DEVICE

[75] Inventor: Egon S. Babler, Northbrook, Ill.

[73] Assignee: EMD Technologies, Inc., Bensenville, Ill.

[21] Appl. No.: 880,459

[22] Filed: May 8, 1992

[51] Int. Cl.[5] ..... A01K 29/00

[52] U.S. Cl. ..... 294/1.4; 294/115

[58] Field of Search ..... 294/1.3-1.5, 294/19.1, 100, 115; 15/104.8, 257.1, 257.6, 257.7

[56] References Cited

U.S. PATENT DOCUMENTS

| | | | |
|---|---|---|---|
| 3,733,098 | 5/1973 | Tobias | 294/1.4 |
| 3,738,697 | 6/1973 | Kahan | 294/1.4 |
| 3,929,363 | 12/1975 | Kahan | 294/100 X |
| 4,194,777 | 3/1980 | Carns | 294/1.4 |
| 4,200,319 | 4/1980 | Cooper | 294/1.4 |
| 4,247,139 | 1/1981 | Grieb . | |
| 4,248,468 | 2/1981 | Hastings . | |
| 4,477,111 | 10/1984 | Crooks | 294/1.4 |
| 4,645,252 | 2/1987 | Riley . | |
| 4,951,987 | 8/1990 | Lebeau . | |
| 5,056,842 | 10/1991 | Lindenberg et al. . | |

FOREIGN PATENT DOCUMENTS

| | | | |
|---|---|---|---|
| 2095156 | 9/1982 | United Kingdom | 294/1.4 |

*Primary Examiner*—David M. Mitchell
*Assistant Examiner*—Dean J. Kramer
*Attorney, Agent, or Firm*—Jenner & Block

[57] ABSTRACT

A refuse collecting device includes a frame configured with a longitudinal channel, an actuating member, a disposable container, and U-shaped retaining members. The actuating member is positioned within the channel and freely slides through the channel. The U-shaped retaining member releasably retains the disposable container to the actuating member. The disposable container is attached to the frame by sliding the container hinge over the U-shaped retaining member. After the container is attached, sliding the actuating member upward within the channel causes the container to close thereby picking up the refuse. The container is self-locking when closed and can be removed by sliding the container off the U-shaped retaining member.

9 Claims, 4 Drawing Sheets

Fig. 1
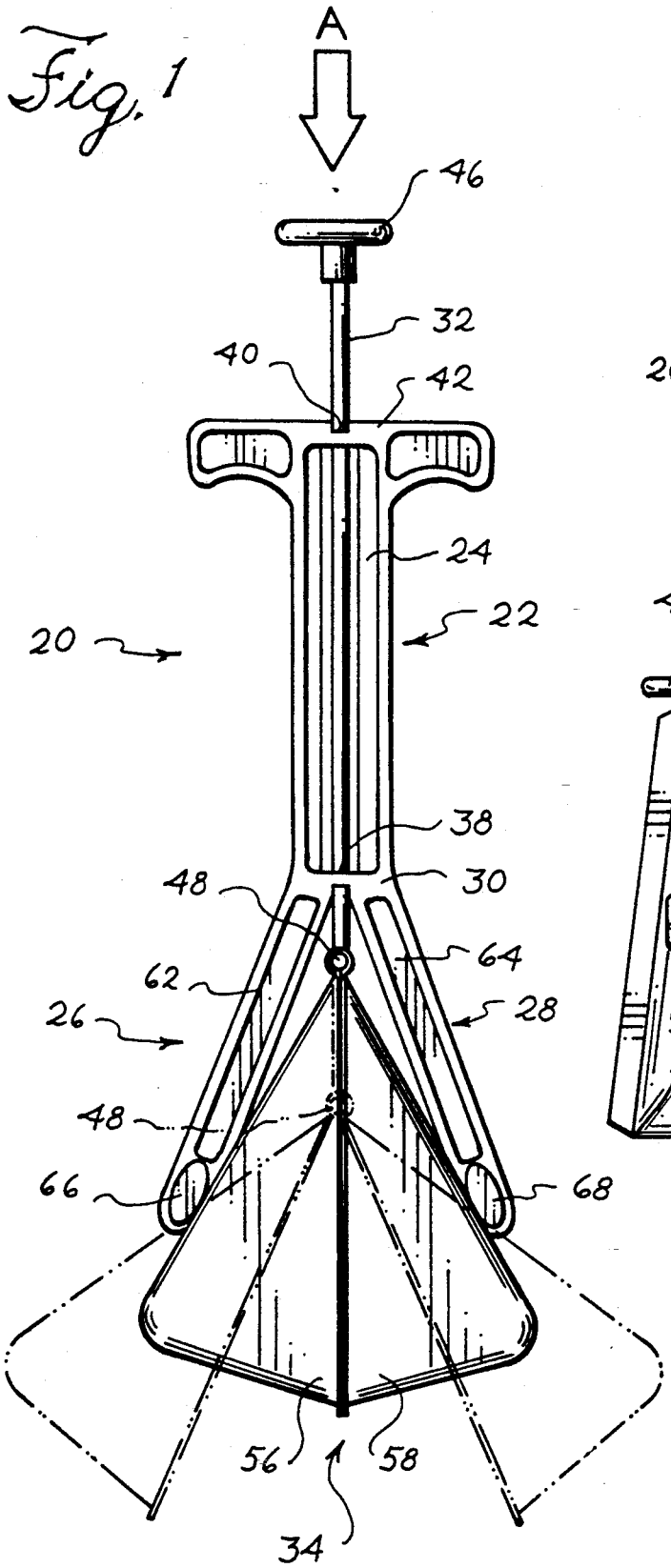
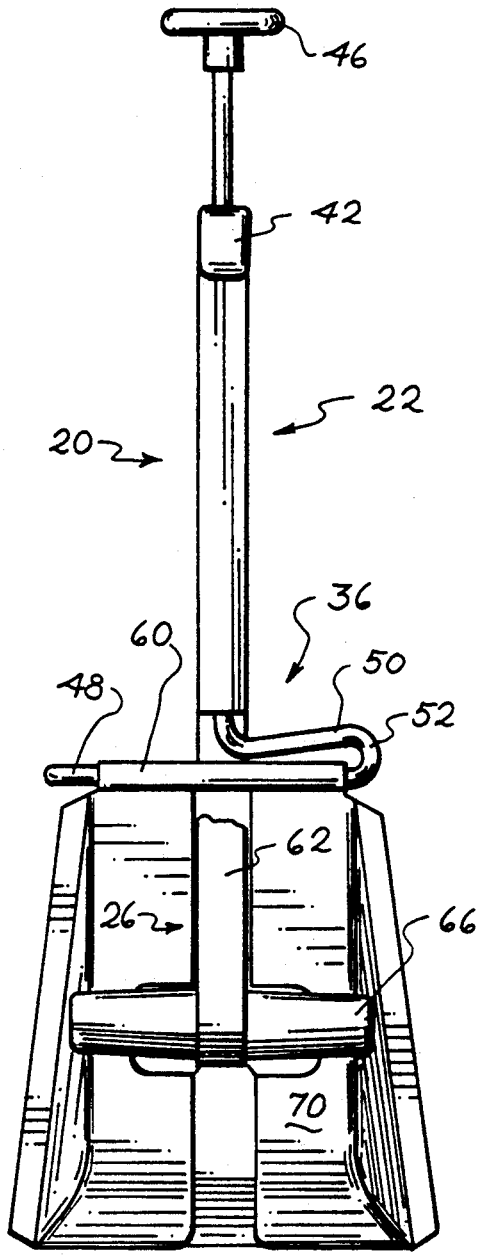
Fig. 2

REFUSE COLLECTING DEVICE

FIELD OF THE INVENTION

This invention relates generally to refuse collecting devices and in particular to refuse collecting devices which are useful for collecting and disposing of solid pet wastes.

BACKGROUND OF THE INVENTION

The proliferation of state and local ordinances requiring the collection and disposal of animal and pet wastes has created a need for an inexpensive, sanitary method of doing so. Several devices have been proposed to deal with the growing problem presented by pet waste. For example, U.S. Pat. No. 4,951,987 discloses a refuse collecting tool for the collection of animal waste. The tool consists of an elliptical scoop permanently attached to a tubular handle having a rod which opens and closes the scoop. By proper manipulation of the device, animal waste is collected within the scoop for further disposal. U.S. Pat. No. 4,248,468 discloses a similar apparatus. While devices such as these may be easier to use than other tools, such as shovels, they still suffer from disadvantages. Notable among the disadvantages is the need to clean the device itself. Because the scoop used to collect the waste is permanently attached to the device, the device must be cleaned to prevent the accumulation of pet waste, a task which is itself hardly pleasant.

Several refuse collecting tools employing disposable scoop-like elements have been proposed to overcome some of the problems associated with permanently attached scoop elements. U.S. Pat. No. 4,645,252, for example, discloses a device which uses commercially available disposable cups to collect the waste. The cup is secured within a frame attached to the end of the handle. Waste is collected by using a lateral movement to scoop the waste into the open cup. Because the cup is detachable and disposable, some of the problems associated with permanently attached scoops are overcome. The device nonetheless suffers from drawbacks. Because of the type of scooping motion required to collect the waste, the outside of the cup can become soiled with the waste thus presenting the user with the unpleasant task of disengaging the waste-soiled cup. In addition, although the cup can be closed with commercially available cup lids, the lid cannot be put in place until after the cup is disengaged from the holder. Thus, in the process of removing the cup from the holder, the potential exists that some of the waste will spill out of the cup.

U.S. Pat. No. 4,247,139 discloses an alternative type of waste collecting device using a detachable, disposable scoop-like element. The device includes a disposable container attached to a handle. A camming mechanism within the handle opens and closes the container. The user places the device over the waste and operates the camming mechanism so that the container is open. After lowering the device until the container sides surround the waste, the user operates the camming mechanism to close the container. As the container closes, the waste is lifted into the container. U.S. Pat. No. 5,056,842 discloses a similar device employing a removable, disposable container. The container is attached to a pair of jaws which form the lower end of the device. A spring within the device moves the jaws outward and in so doing opens the container. The device is placed so that the open container surrounds the waste. As the spring moves the jaws inward, the container closes around the waste thereby picking up the waste. The devices in U.S. Pat. Nos. 4,247,139 and 5,056,842 overcome some of the problems associated with refuse collecting devices employing removable scoop-like elements. These devices help to prevent contamination of the outside of the containers because the devices use a vertical motion rather than a lateral one to collect the waste. In addition, the devices help to prevent spillage of the waste because the containers are closed before they are removed from the devices. Problems exists, however, due to the complexity of the mechanisms for opening and closing the containers. The camming mechanism in U.S. Pat. No. 4,247,139, for example, requires the cooperative motion of two wire-like legs over four cam followers. In addition, the device uses flexible guides to properly position the closed container on the device. The spring mechanism in U.S. Pat. No. 5,056,842 requires the cooperative motion of the spring and the two movable jaws. The complexity of these devices contributes to the expense in manufacturing them. In addition, the relatively large number of moving parts presents maintenance problems in that any of these parts may become fouled by debris or worn out by use.

A need exists for a refuse collecting device that is sanitary, easy to use and maintain, and inexpensive to produce.

SUMMARY OF THE INVENTION

It is therefore an object of this invention to provide a refuse collecting device which is sanitary, easy to use and maintain, and inexpensive.

It is another object of this invention to provide a refuse collecting device which requires little if any cleaning by the user.

Yet another object of this invention is to provide a refuse collecting device which has a minimum of moving parts that can become fouled by debris or worn out through use.

Still another object of this invention is to provide a refuse collecting device which has a small number of parts and is therefore inexpensive to manufacture.

A refuse collecting device in accordance with the invention includes a frame configured with a longitudinal channel, an actuating member, a disposable container, and retaining means. The actuating member is positioned within the channel and slides freely through the channel. The retaining means releasably retains the disposable container to the actuating member.

BRIEF DESCRIPTION OF THE DRAWINGS

FIG. 1 is a front view of a refuse collecting device in accordance with the invention;

FIG. 2 is a side view of the device in FIG. 1;

DETAILED DESCRIPTION OF THE INVENTION

Figure 3:
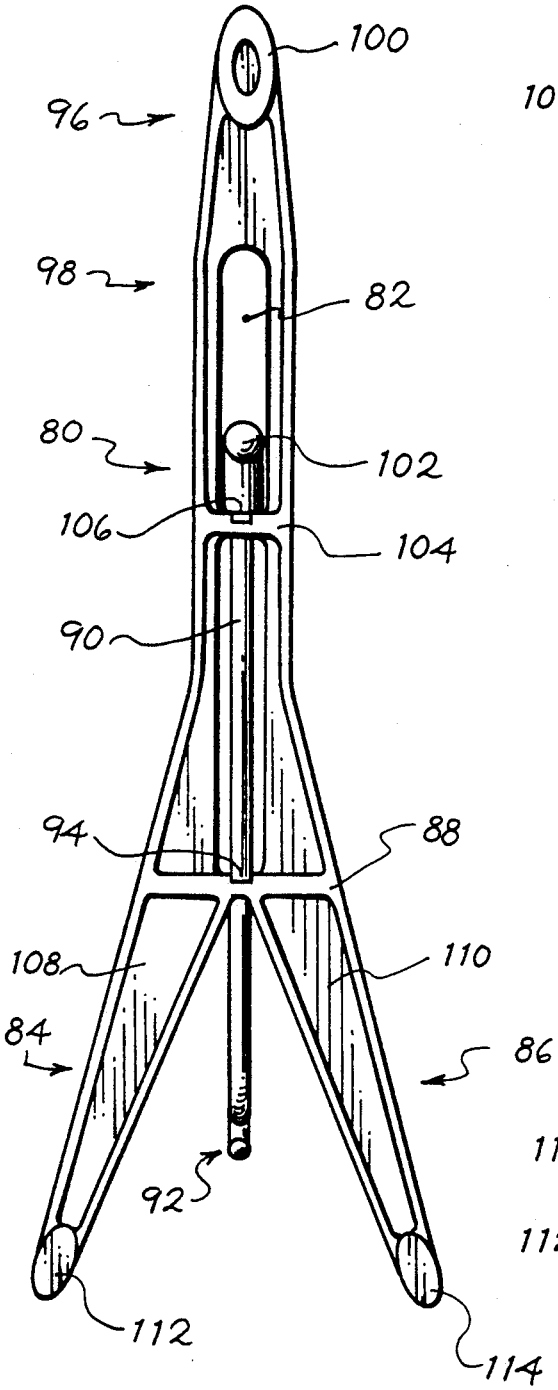
FIG. 3 is a front view of a second embodiment of a frame comprising a part of a refuse collecting device in accordance with the invention.

Referring now to the drawings generally, and in particular to FIGS. 1 and 2, a refuse collecting device 20 according to the present invention is shown. Device 20 includes a frame member 22 having a longitudinal channel 24, a pair of legs 26 and 28 extending from the lower end 30 of frame member 22, an actuating member 32 having a U-shaped retaining portion 36, and a disposable container 34. Longitudinal channel 24 extends through the interior of frame member 22 and includes two apertures 38 and 40 in the upper 42 and lower 30 ends of frame member 22. The lower aperture 38 is located in end 30 between legs 26 and 28, and the upper aperture 40 is located in the upper end 42 opposite lower end 30.

Actuating member 32 is positioned within channel 24 and extends through apertures 38 and 40. Actuating member 32 slides freely within channel 24. The top end of actuating member 32 includes a cap 46 which retains actuating member 32 in channel 24. As shown in FIGS. 1 and 2, cap 46 is substantially circular and has a diameter greater than that of aperture 40. Other types of caps which would retain actuating member 32 within channel 24 are possible, for example, cap 46 could consist of a rod wider than aperture 40 and positioned transverse to aperture 40. The end of actuating member 32 extending through aperture 38 terminates in U-shaped retaining portion 36.

U-shaped retaining portion 36 includes a retaining arm 48, an upper portion 50, and a curved portion 52 as shown in FIG. 2 which is partially cut-away to show U-shaped retaining portion 36 more clearly. U-shaped retaining portion 36 may be constructed as a unitary element, as shown in FIGS. 1 and 2, in which there are no clearly defined junctures among arm 48, upper portion 50, and curved portion 52. Alternatively, arm 48, upper portion 50, and curved portion 52 could be constructed as separate pieces which are ultimately joined together by conventional means to construct U-shaped retaining portion 36. U-shaped retaining portion 36 is adapted to releasably retain disposable container 34.

Disposable container 34 is a one piece unit molded out of light weight plastic. Especially preferred are materials which have enough rigidity that container 34 is biased in an open configuration. Container 34 has two half sections 56 and 58 joined together by hinge a 60 in order to attach the disposable container 34 to the actuating member 32. Half sections 56 and 58 have substantially triangular cross sections as shown in FIG. 1. Retaining arm 48 is inserted through hinge 60. Retaining arm 48 is shown twice in FIG. 1, once in a dashed line which indicates the relative position of U-shaped retaining portion 36 when actuating member 32 has been moved downward through channel 24 in the direction indicted by arrow A. The relationship between U-shaped retaining portion 36 and disposable container 34 is more clearly shown in FIG. 2 Hinge 60 slides over arm 48 so that disposable container 34 can easily be released from device 20. When disposable container 34 is attached to device 20 by hinge 60, legs 26 and 28 abut the outside surfaces of half sections 56 and 58. Each leg 26 and 28 includes a longitudinal member 62 and 64, and a transverse pivot member 66 and 68. The configuration of legs 26 and 28 is more clearly shown in FIG. 2 in which only the leg 26 is shown. Leg longitudinal member 62 extends downwardly from frame member 22. The transverse pivot member 66 is secured to the end of leg 26. When disposable container 34 is retained in device 20 by hinge 60, transverse pivot member 66 abuts the back 70 of half section 56.

Figure 4:
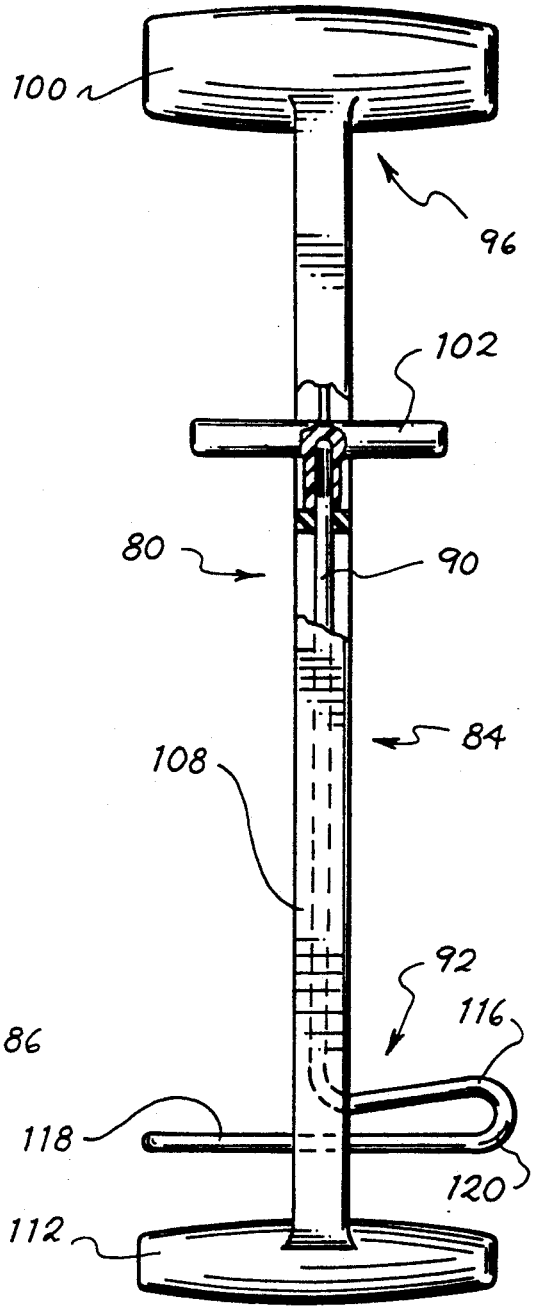
FIG. 4 is a side view of the frame in FIG. 3.

FIGS. 3 and 4 illustrate the preferred embodiment of the invention and include a frame member 80. Frame member 80, as with frame member 22 in FIGS. 1 and 2, includes a longitudinal channel 82, a pair of legs 84 and 86 extending from the lower end 88 of frame member 80, and an actuating member 90 having a U-shaped retaining portion 92. Frame member 80 differs from member 22 primarily in the configuration of channel 82 and actuating member 90. Actuating member 90 extends through an aperture 94 defined by channel 82 in lower end 88 between legs 84 and 86. However, unlike channel 24 of frame member 22, channel 82 does not extend through the upper end 96 of frame member 80. Instead, channel 82 ends at a location 98 spaced apart from the upper end 96 of the frame member 80. In addition, frame member 80 has a handle 100 attached to the upper end 96. Handle 100 and a lifting grip member 102 secured to the upper end of actuating member 90 are positioned so that the user can simultaneously grasp the handle 100 and the grip member 102 and slide actuating member 90 upwardly within channel 82. The relationship between handle 100 and grip 102 is more clearly shown in FIG. 4 which is partially cut away to show the location of the grip 102.

Frame member 80 also has a reinforcing member 104 which spans channel 82 as shown in FIG. 3. Reinforcing member 104 serves to strengthen frame member 80. Reinforcing member 104 also has an aperture 106 through which actuating member 90 extends. The combination of the grip 102 and the reinforcing member 104 limits the range of motion of actuating member 90 within channel 82.

The lower end of actuating member 90 which extends through aperture 94 between legs 84 and 86 terminates in the U-shaped retaining portion 92. Legs 84 and 86 consist of longitudinal members 108 and 110 extending outward at an angle from the lower end 88 and pivot members 112 and 114. FIG. 4 is a side view of frame member 80 which shows only the leg 84 and the relationship between longitudinal member 108 and the pivot member 112. The pivot 112 is secured to the end of longitudinal member 108 opposite frame member lower end 88. When a disposable container (not shown) is attached to frame 80, the pivot member 112 spans the back of one of the container half sections.

U-shaped retaining portion 92 is positioned between legs 84 and 86. As shown in FIG. 4, U-shaped retaining portion 92 is similar to U-shaped retaining portion 36 of FIG. 2 and has an upper portion 116, a retaining arm 118, and a curved portion 120 between portion 116 and retaining arm 118. Retaining arm 118 releasably retains the disposable container 34 (not shown).

Figure 5:
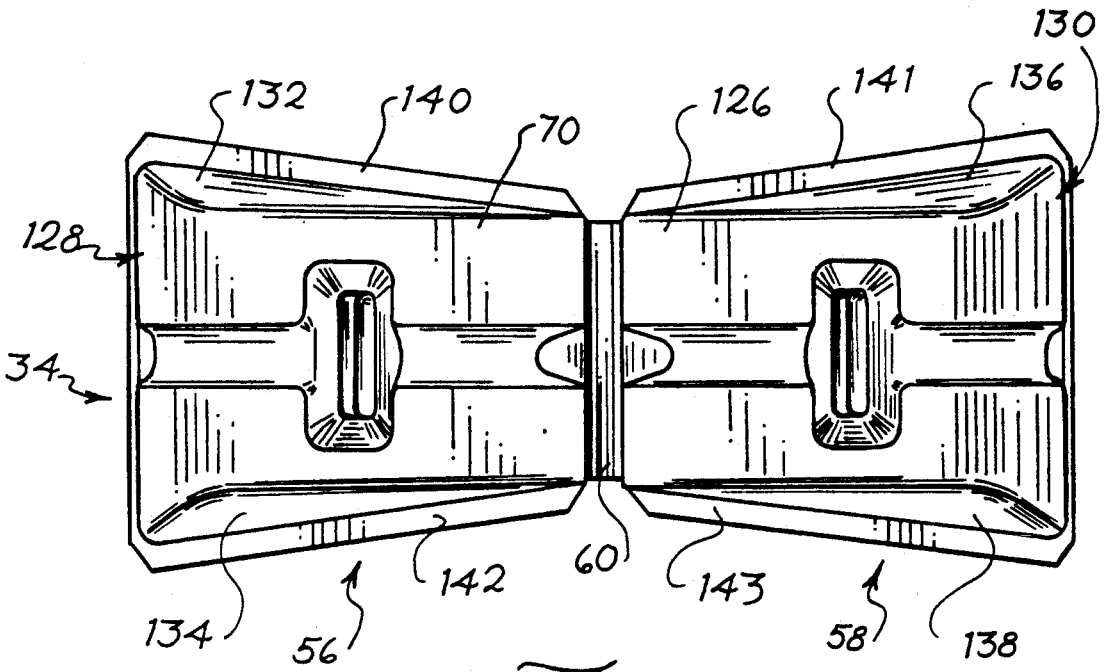
FIG. 5 is a top view of an open disposable container comprising a part of a refuse collecting device in accordance with the invention.
Figure 6:
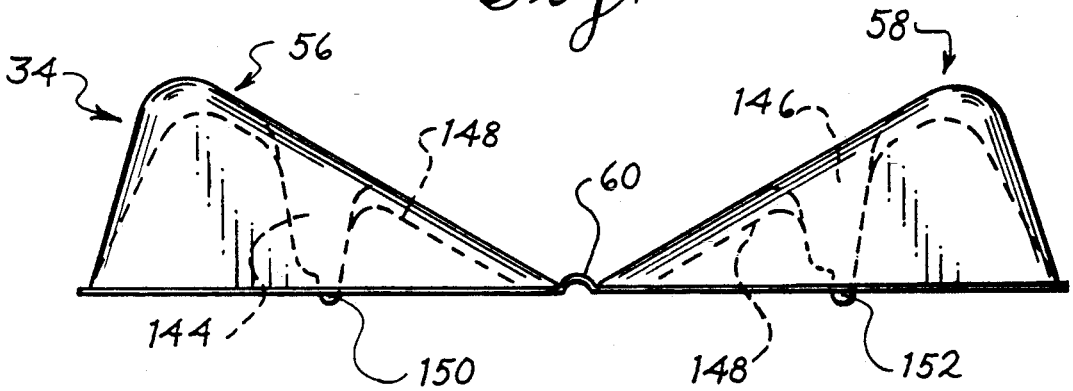
FIG. 6 is a side view of the open disposable container in FIG. 5.
Figure 7:
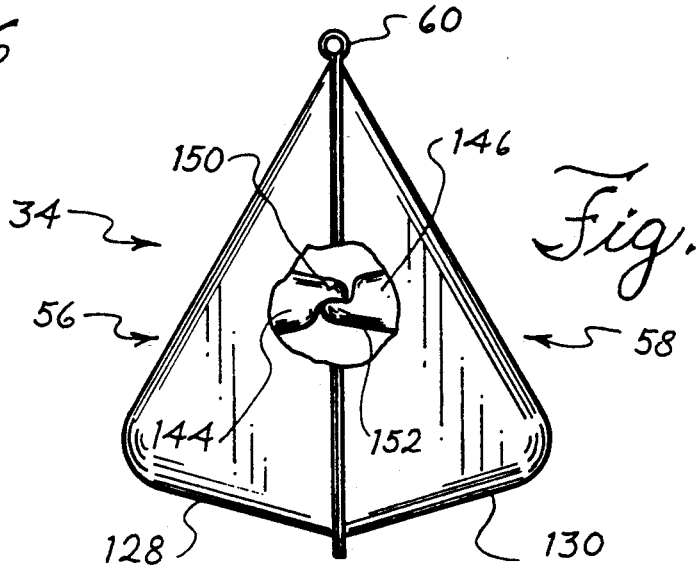
FIG. 7 is a side view of the container in FIGS. 5 and 6 when the container closed.

One embodiment of the disposable container 34 is shown in detail in FIGS. 5, 6, and 7. Container 34 includes two half sections 56 and 58 connected by the hinge 60. When disposable container 34 is attached to the frame member (not shown) such as frame member 22 or frame member 80, hinge 60 is slid over the retaining arm (not shown), such as am 48 or arm 118, of the U-shaped retaining portion. Container 34 is released from the frame 22 or the frame 80 by sliding the hinge 60 off the U-shaped retaining portion 36 or 92.

Half sections 56 and 58 include backs 70 and 126, bottoms 128 and 130, and sides 132, 134, 136, and 138. Half sections 56 and 58 may also include lips 140, 141, 142, and 143 extending outwardly from sides 132, 134, 136, and 138. Sides 132, 134, 136, and 138 are substantially triangular thus giving half sections 56 and 58 substantially triangular cross sections as shown in FIG. 6. FIG. 6 also illustrates a pair of latch arms 144 and 146 extending inwardly from the inside surface 148, shown by a dashed line, of backs 70 and 126. The latch arms 144 and 146 include hooks 150 and 152 which cooperate to lock half sections 56 and 58 together when container 34 is closed, as shown in FIG.

Figure 8:
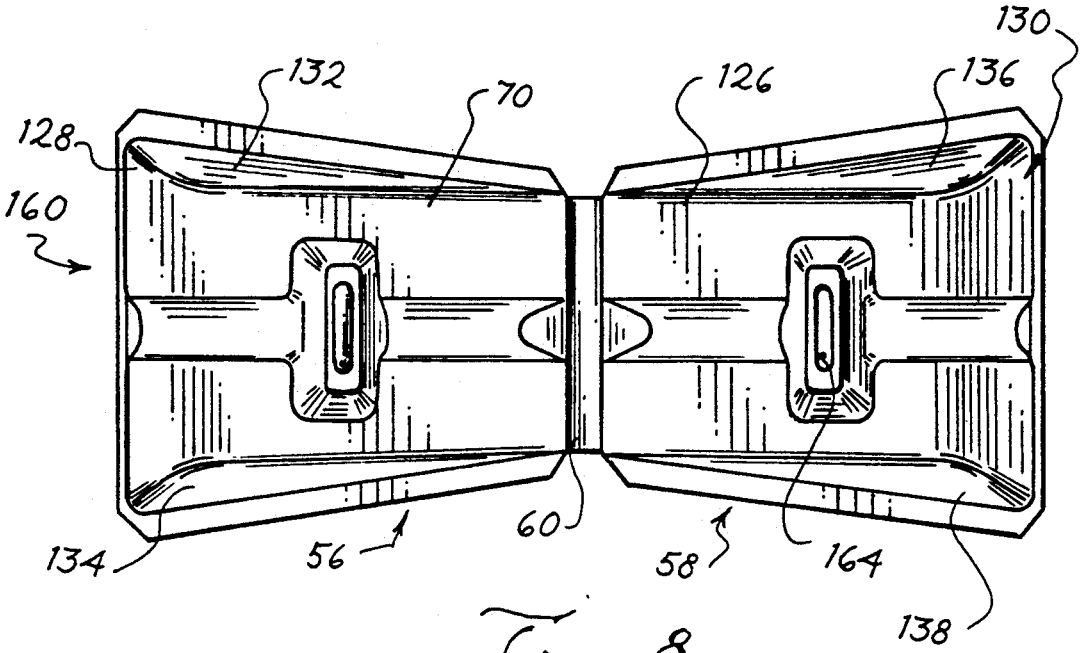
FIG. 8 is a top view of a second embodiment of an open disposable container comprising a part of a refuse collecting device in accordance with the invention.
Figure 9:
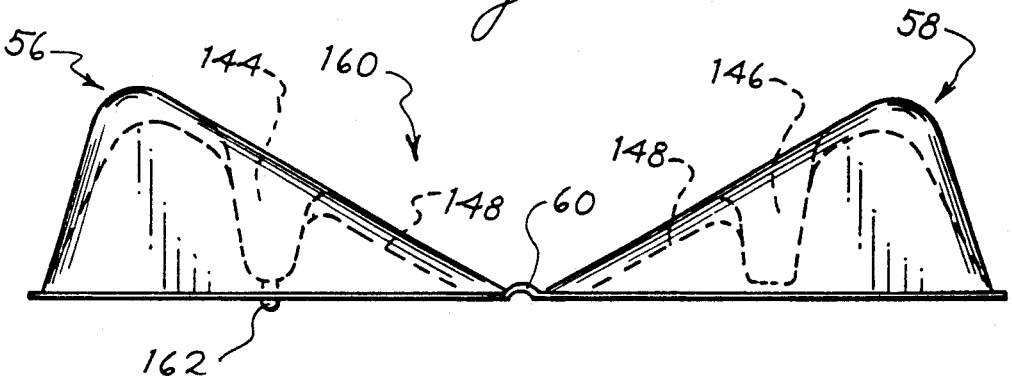
FIG. 9 is a side view of the open disposable container in FIG. 8.
Figure 10:
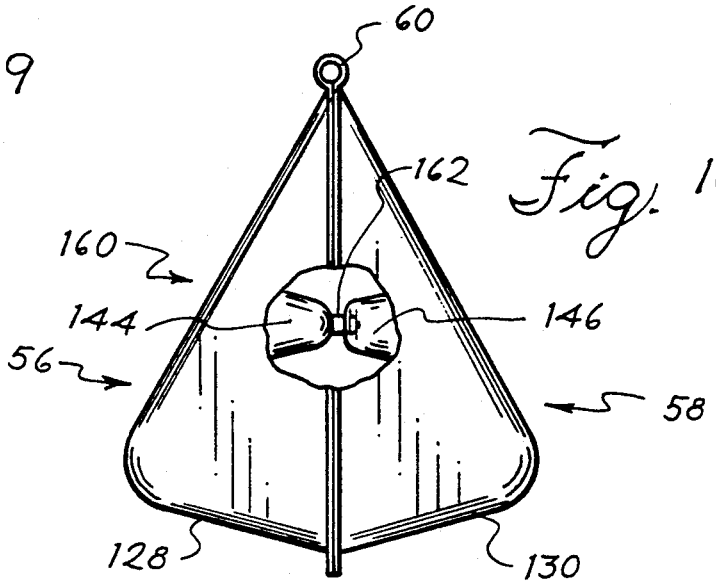
FIG. 10 is a side view of the container in FIGS. 8 and 9 when the container closed.

FIGS. 8, 9, and 10 show a second embodiment 160 of the disposable container 34 according to the present invention. Container 160, as with container 34 in FIGS. 5, 6, and 7, includes two half sections 56 and 58 connected by the a hinge 60 which is retained by the U-shaped retaining member 36 or 92. Half sections 56 and 58 include backs 70 and 126, bottoms 128 and 130 and substantially triangular sides 132, 134, 136, and 138. Container 160 also has two projections 144 and 146 extending inwardly from the inner surface 148 of backs 70 and 126.

The primary difference between container 160 and container 34 in FIGS. 5, 6, and 7, is in the locking mechanism used to securely close container 160. A centrally located tongue 162 projects from the end of projection 144. A groove 164 is configured in the center of the end of projection 146. FIG. 10 has a cut away portion showing the relationship between tongue 162 and groove 164. When container 160 is closed, tongue 162 engages the groove 164 thereby locking together half sections 56 and 58.

The advantages of the present invention are now explained by way of illustration of the use of device 20 of FIGS. 1 and 2. To attach the disposable container 34 to frame 22, the user slides actuating member 32 toward lower end 30. This motion moves U-shaped retaining portion 36 toward the ends of legs 26 and 28, as shown by the dashed line in FIG. 1. The user attaches container 34 to frame 22 by sliding hinge 60 over retaining arm 48. Before device 20 is used to collect refuse, container 34 is in an open configuration when actuating member 32 is in this lower position, as shown by the dashed lines in FIG. 1. The spring-like characteristics of the container 34 tend to keep the container 34 open and to keep the actuating member 32 in the lower position. Alternatively, device 20 can employ a spring located in the frame 22 to bias the actuating member 32 in a downward direction to keep the container 34 open. The user next places open container 34 over the refuse to be collected. When the user pulls up on actuating member 32, in the direction of the upper end 42 of frame member 22, pivot members 66 and 68 cause the half sections 56 and 58 of container 34 to rotate toward the closed position, and in so doing, container 34 is effective to scoop up the refuse. The user continues to pull on actuating member 32 until U-shaped retaining member 36 is just below the lower end of frame 22. At this location, container 34 is entirely closed and the internal locking arms 144 and 146 securely fasten half section 56 to half section 58. To release container 34, the user simply slides actuating member 32 down towards lower end 30. Because container 34 is securely closed by the locking arms 144 and 146, container 34 is prevented from reopening. When actuating member 32 is in the lower position indicated by the dashed lines in FIG. 1, the user can slide container 34 off retaining arm 48 and then properly disposes of container 34.

Device 20 is thus easy to use. Container 34 is readily attached to and removed from frame 22 by sliding hinge 60 over retaining arm 48. Device 20 also is economic to produce because it contains a limited number of parts. Device 20 does not contain parts such as springs which can wear out or become clogged by debris. Device 20 is thus easy to maintain because the only moving parts are actuating member 32, which freely slides within channel 24, and disposable container 34. Device 20 is also sanitary. Because container 34 is self locking, the user does not have to contact the refuse. In addition, the refuse only contacts container 34 and thus frame member 22 does not become soiled by the refuse.

What is claimed is:

1. A device for collecting refuse comprising:

a frame member configured with a longitudinal channel, having an upper end, a lower end, and a pair of legs extending outwardly from the lower end of said frame member, and an actuating member slidably extending through said channel;

a disposable container having two half sections each half section having a substantially triangular cross section and a hinge connecting said two half sections; and a U-shaped retaining member located between said legs for releasably retaining said hinge of said disposable container to said actuating member, said U-shaped retaining member having one upper portion, one curved portion, and one retaining arm, said upper portion secured to said actuating member and extending from said actuating member to said curved portion, said retaining arm being longer than said upper portion of said U-shaped retaining member and extending from the opposite end of said curved portion, said upper portion being substantially parallel to said retaining arm and being substantially orthogonal to said channel.

2. The device in claim 1 wherein said frame member further comprises a handle member, said handle member being affixed to said upper end and being substantially orthogonal to said channel and wherein said channel terminates at a location spaced apart from said upper end.

3. The device in claim 2 wherein said actuating member further comprises a top end and a grip member affixed to the top end of said actuating member and adapted to retain the actuating member in the channel.

4. The device in claim 1 wherein said disposable container further comprises two backs adjoining said hinge and locking means for locking one half section to said second half section when said disposable container is in a closed configuration, said locking means comprising a pair of arms projecting inwardly from the inside surface of said two backs, each arm terminating in a locking member adapted to engage the locking member of the other arm when said disposable container is ian a closed configuration.

5. The device in claim 4 wherein said locking members comprise a pair of hooks, said hook of one half section grasping said hook of said second half section when said disposable container is in a closed configuration.

6. The device in claim 4 wherein said locking member of one back comprises a tongue member and said locking member of said second back comprises a groove, said groove capturing said tongue member when said disposable container is in a closed configuration.

7. A disposable container for use with a refuse collecting device comprising:

two half sections having substantially triangular cross sections, each half section including a back, a bottom, and two substantially triangular sides;

a hinge connecting said two half sections and adapted to be releasably retained by said refuse collecting device; and a pair of locking arms for locking one said half section to said second half section when said disposable container is in a closed configuration, one locking arm projecting inwardly from the inside surface of each of said backs and terminating in a locking member adapted to engage the locking member of the other arm when said disposable container is in a closed configuration.

8. The disposable container in claim 7 wherein said locking members comprise a pair of hooks, said hook of one half section grasping said hook of said second half section when said disposable container is in a closed configuration.

9. The disposable container in claim 7 wherein said locking member of one half section comprises a tongue member and said locking member of said second half section comprises a groove, said groove capturing said tongue member when said disposable container is in a closed configuration.

* * * * *

UNITED STATES PATENT AND TRADEMARK OFFICE

CERTIFICATE OF CORRECTION

PATENT NO. : 5,326,143

DATED : July 5, 1994

INVENTOR(S) : Egon S. Babler

It is certified that error appears in the above-identified patent and that said Letters Patent is hereby corrected as shown below:

Col. 5, line 18 after "FIG." insert -- 7.--.

Col. 6, line 64 after "is" delete "ian" and substitute therefor --in--.

Signed and Sealed this

Twentieth Day of September, 1994

Bruce Lehman

*Attest:*

BRUCE LEHMAN

*Attesting Officer*

*Commissioner of Patents and Trademarks*